US005213408A

United States Patent [19]

Shiau

[11] Patent Number: 5,213,408

[45] Date of Patent: May 25, 1993

[54] VARIABLE FOCUSING FLASHLIGHT

[76] Inventor: Shoei-Shuh Shiau, No. 10, Alley 1, Lane 551, Sec. 1, Wan-Shou Rd., Guei-Shan Hsiang, Taoyuan Hsien, Taiwan

[21] Appl. No.: 891,771

[22] Filed: Jun. 1, 1992

[51] Int. Cl.[5] ..... F21L 7/00; F21L 15/02

[52] U.S. Cl. ..... 362/187; 362/203; 362/205

[58] Field of Search ..... 362/202, 205, 187, 208, 362/203

[56] References Cited

U.S. PATENT DOCUMENTS

| | | | |
|---|---|---|---|
| 4,429,351 | 1/1984 | Petzl et al. | 362/205 |
| 4,907,141 | 3/1990 | Wang | 362/205 |
| 4,916,588 | 4/1990 | Chu | 362/203 |
| 5,113,326 | 5/1992 | Maglica | 362/205 |
| 5,126,927 | 6/1992 | Reeves et al. | 362/205 |

*Primary Examiner*—Richard R. Cole
*Attorney, Agent, or Firm*—Darby & Darby

[57] ABSTRACT

A variable focusing flashlight includes a barrel which has a battery source of power contained therein and a tail cap mounted on one end of the barrel and having a compression spring provided thereon for urging the battery source towards the other end of the barrel. A lamp base retains a lamp bulb adjacent the other end of the barrel and includes a stationary receptacle mounted in the other end of the barrel and having an axially extending through bore formed therein. A pair of conductors are mounted in the stationary receptacle such that one of the conductors serves to couple the battery source and a first lamp electrode and the other one of the conductors serves to couple a second lamp electrode and the barrel. A movable receptacle has a plate portion disposed between the stationary receptacle and the battery source and formed with an opening and an upward extension that extends slidably into the through bore of the stationary receptacle. A head assembly is rotatably mounted on the other end of the barrel and has a substantially parabolic reflector with an open tail end to receive the lamp bulb and which abuts against one end of the upward extension of the movable receptacle. The head assembly is controllably translatable along the barrel when rotated with respect to the barrel.

6 Claims, 5 Drawing Sheets

VARIABLE FOCUSING FLASHLIGHT

BACKGROUND OF THE INVENTION

1. Field of the Invention

The invention relates to a variable focusing flashlight, more particularly to a variable focusing flashlight which has a simple construction and an improved power supply switch configuration.

2. Description of the Related Art

Variable focusing flashlights are known in the art. Referring to FIGS. 1, 2 and 3, a conventional variable focusing flashlight disclosed in U.S. Pat. No. 4,942,505 is shown to comprise a metal barrel (11) which is adapted to receive dry cell batteries (10) therein. The barrel (11) has a first open end which is formed with an inwardly projecting annular lip (111). A lower insulator receptacle (12) is provided inside the barrel (11) adjacent to the first open end of the same. A pair of conductors (121, 122) are mounted in the receptacle (12). One end of the conductor (121) is bent so as to contact the lip (111). One end of the conductor (122) extends through a closed bottom of the receptacle (12) so as to contact the positive terminal of the dry cell batteries (10). The receptacle (12) is further formed with a pair of arcuate recesses (120). An upper insulator receptacle (13) is formed with a pair of holes (131) which are aligned with the conductors (121, 122). A lamp bulb (14) is provided with lamp electrodes (141) which pass through the holes (131) of the receptacle (13) and which connect electrically with the conductors (121, 122). The receptacle (13) is provided with arcuate extensions (132) which are received in the arcuate recesses (120) of the receptacle (12) The receptacles (12, 13) are disposed on two sides of the lip (111) of the barrel (11) when installed. A tail cap (143) threadedly encloses a second open end of the barrel (11). The tail cap (143) is provided with a helical compression spring (142) which urges the dry cell batteries (10) toward the conductor (122). A head assembly (15) has a substantially parabolic reflector (151) and threadedly engages the first open end of the barrel (11). The parabolic reflector (151) has an open tail end which is in contact with the receptacle (13). The head assembly (15) is rotated relative to the barrel (11) so as to vary the light output of the flashlight and so as to make or break electrical connection between the dry cell batteries (10) and the lamp bulb (14).

Rotation of the head assembly (15) in a direction toward the barrel (11) causes the parabolic reflector (151) to push the receptacle (13) toward the dry cell batteries (10). The conductor (121) does not contact the lip (111) at this time, thereby breaking electrical connection between the lamp bulb (14) and the dry cell batteries (10). Rotation of the head assembly (15) in a direction away from the barrel (11) causes the spring (142) to expand, thereby resulting in electrical contact between the conductor (121) and the lip (111) to cause the operation of the lamp bulb (14). Further rotation of the head assembly (15) in this direction varies the position of the parabolic reflector (151) relative to the lamp bulb (14), thereby varying the dispersion of the light output of the flashlight.

The following are some of the drawbacks of the above-disclosed variable focusing flashlight:

1. The flashlight is turned off by breaking electrical contact between the conductor (121) and the lip (111), thereby disconnecting the lamp bulb (14) from the negative terminal of the dry cell batteries (10).

2. The flashlight is relatively inconvenient to assemble. Note that the receptacle (12) has to be inserted from the second open end of the barrel (11) before the receptacle (13) can be assembled thereto because of the presence of the lip (111). Assembly of the receptacles (12, 13) is therefore difficult to conduct, especially if the barrel (11) is relatively long.

3. The receptacle (13) moves the receptacle (12) by a relatively small distance so as to turn on or turn off the flashlight. The conductor (121) should therefore be precisely bent so as to ensure accurate power supply switching. Precise bending of the conductor (121) is difficult to achieve. If the conductor (121) is improperly bent, the power supply switch of the flashlight is disabled, thereby maintaining the flashlight in an on or off state.

4. The receptacles (12, 13) must be properly matched so as to achieve tight connection between the same. Improper matching of the receptacles (12, 13) may result in the untimely disengagement of the receptacles (12, 13) when replacement of the lamp bulb (14) or the dry cell batteries (10) is being effected.

5. Constant contact between the conductor (122) and the dry cell batteries (10) can cause wearing of the former, thereby reducing the useful life of the flashlight.

6. Machining of the lip is difficult to achieve. The power supply switch of the flashlight is affected if the lip (111) is relatively thick. The lip (111), however, easily breaks if the lip (111) is relatively thin.

SUMMARY OF THE INVENTION

Therefore, the objective of the present invention is to provide a variable focusing flashlight which can overcome the drawbacks associated with the above-described prior art.

More specifically, the objective of the present invention is to provide a variable focusing flashlight which has a simple construction and an improved power supply switch configuration.

Accordingly, the preferred embodiment of a variable focusing flashlight of the present invention comprises:

a barrel having a battery source of power contained therein;

a tail cap mounted on one end of the barrel and having a compression spring provided thereon for urging the battery source towards the other end of the barrel;

a lamp bulb having a pair of lamp electrodes;

a lamp base for retaining the lamp bulb adjacent the other end of the barrel and including: a stationary receptacle mounted to the barrel in the other end of the barrel and having a bottom side and an axially extending through bore formed therein; a first conductor mounted in the stationary receptacle and electrically connecting with one of the lamp electrodes, said first conductor having one end which extends radially along the bottom side of the stationary receptacle within the circumference of the barrel; a second conductor mounted in the stationary receptacle and electrically coupling the other one of the lamp electrodes and the barrel; a movable receptacle having a plate portion disposed between the stationary receptacle and the battery source, said plate portion being formed with an opening and an upward extension which extends slidably into the through bore of the stationary receptacle and which is longer than the through bore; and a movable contact provided in the opening; and a head assembly rotatably mounted on the other end of the barrel and having a substantially planar lens and a substantially parabolic reflector with an open tail end to receive the lamp bulb and which abuts against one end of the upward extension of the movable receptacle, said head assembly being controllably translatable along the barrel when rotated with respect to the barrel.

Rotation of the head assembly in a direction toward the barrel causes the reflector to push the movable receptacle and the battery source against the action of the spring, thereby moving the movable contact away from the first conductor to break electrical connection between the lamp bulb and the battery source. Rotation of the head assembly in a direction away from the barrel causes the spring to expand and push the movable receptacle and the movable contact toward the first conductor to make electrical connection between the lamp bulb and the battery source.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
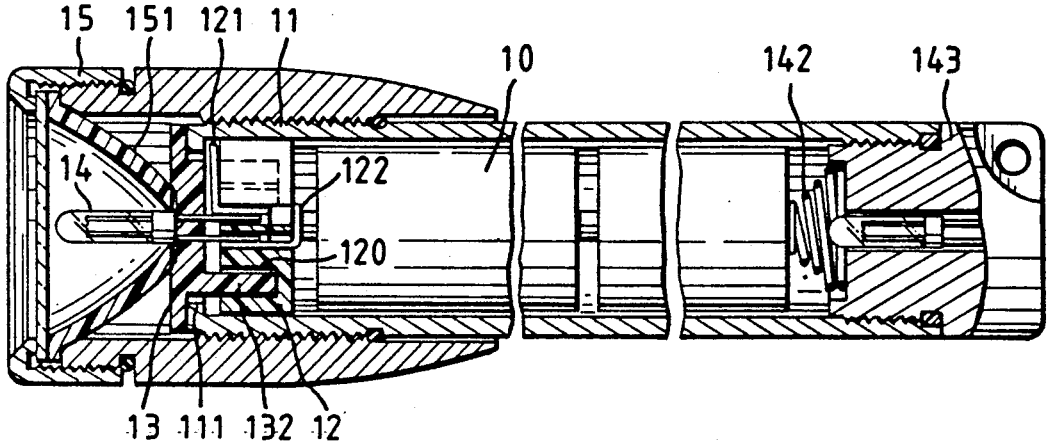
FIG. 1 PRIOR ART
FIG. 1 is a sectional view illustrating the assembly of a conventional variable focusing flashlight disclosed in U.S. Pat. No. 4,942,505.
Figure 2:
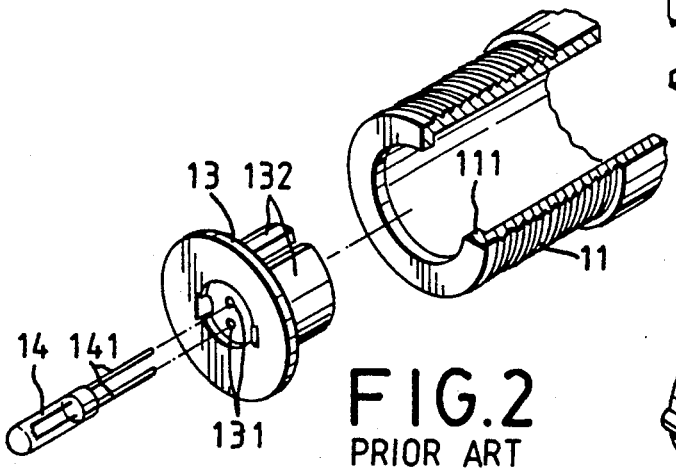
FIG.2 PRIOR ART
FIG. 2 is a fragmentary exploded view of the variable focusing flashlight shown in FIG. 1.
Figure 3:
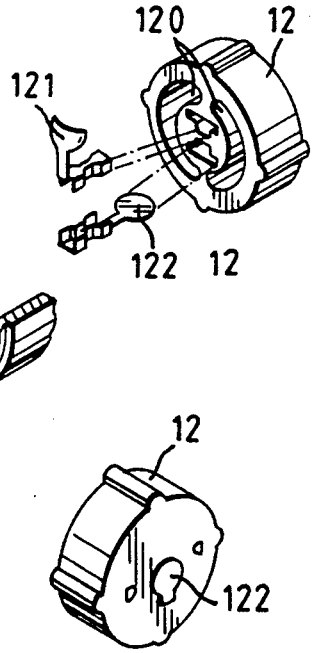
FIG.3 PRIOR ART
FIG. 3 is a rear perspective view of a lower insulator receptacle of the variable focusing flashlight shown in FIG. 1.
Figure 4:
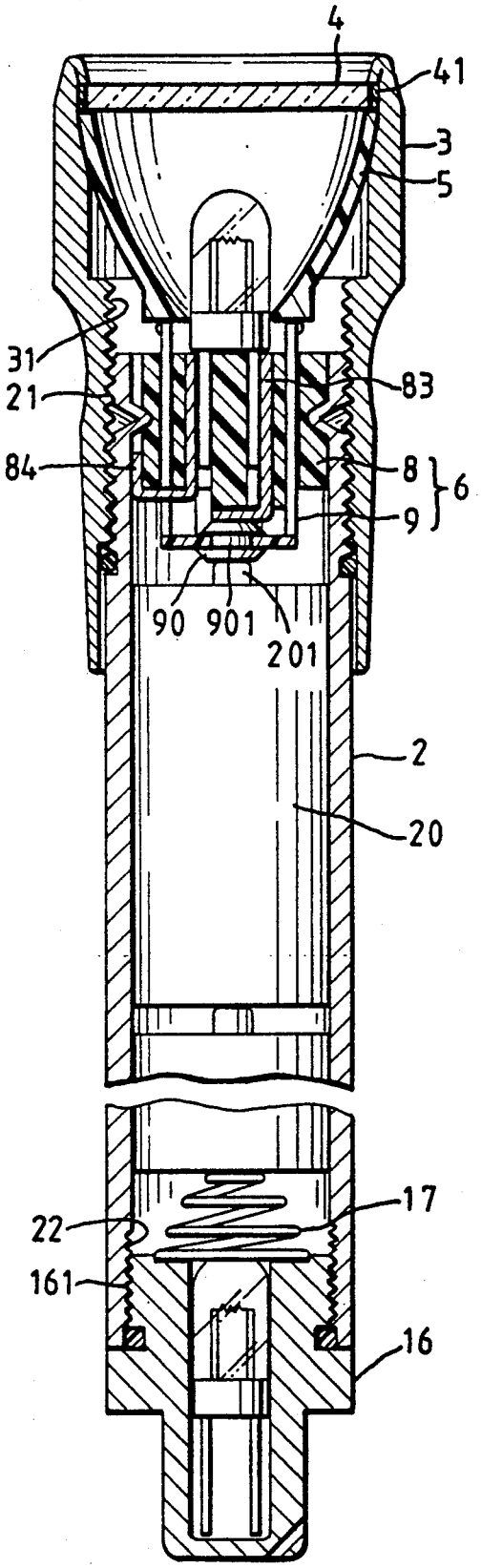
FIG. 4 is a sectional view illustrating the assembly of the preferred embodiment of a variable focusing flashlight according to the present invention.
Figure 5:
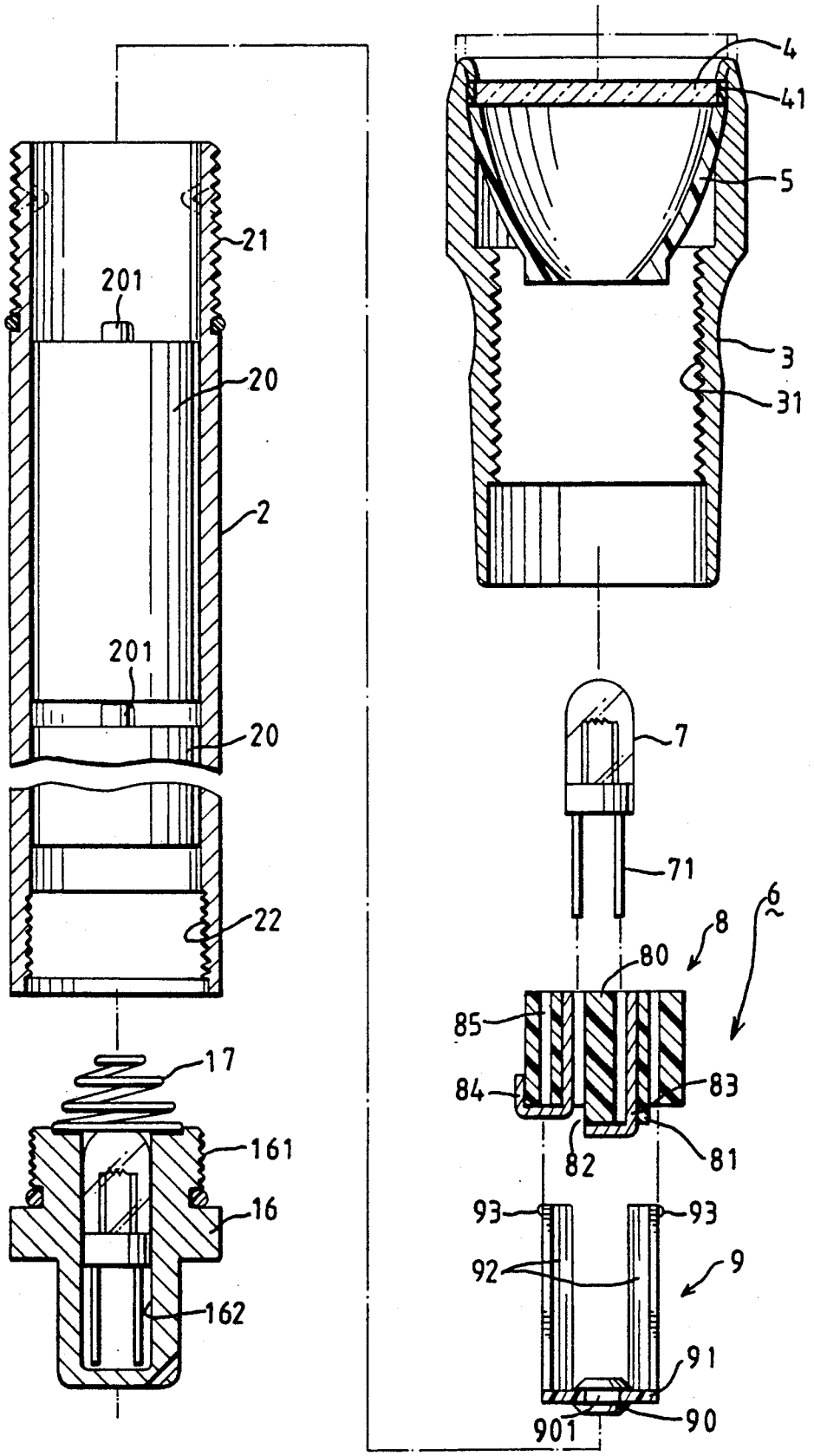
FIG. 5 is an exploded view of the preferred embodiment.
Figure 7:
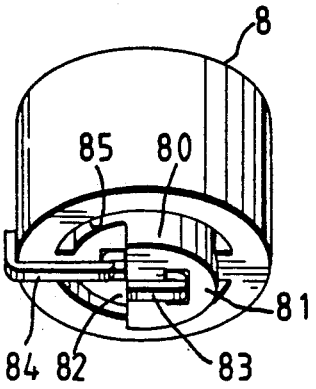
FIG. 7 is a bottom perspective view of the lamp base shown in FIG. 6.
Figure 6:
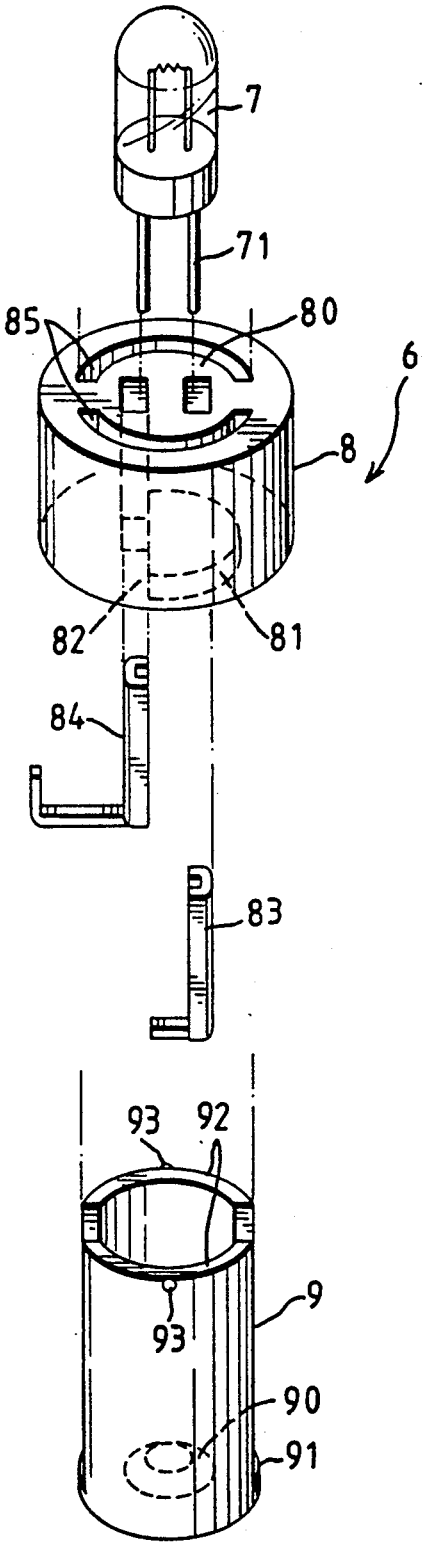
FIG. 6 illustrates an exploded view of a lamp base of the variable focusing flashlight of the present invention.

Referring to FIGS. 4, 5, 6 and 7, the preferred embodiment of a variable focusing flashlight according to the present invention is shown to comprise a barrel (2), a head assembly including a head (3), a substantially planar lens (4) and a substantially parabolic reflector (5), a lamp base (6), a light bulb (7) and a tail cap (16).

The barrel (2) is a tubular conductor which is adapted to receive a number of dry cell batteries (20). The barrel (2) has a first open end which is provided with an external screw thread (21) and a second open end which is provided with an internal screw thread (22).

The head (3) has a tail end which is provided with an internal screw thread (31) so as to engage threadedly with the external screw thread (21) of the barrel (2). The lens (4) and the parabolic reflector (5) are press fitted into the head (3). The parabolic reflector (5) has an open tail end which extends into the first open end of the barrel (2). A sealing ring (41) is disposed around the periphery of the lens (4) so as to prevent water from seeping into the head (3).

The lamp base (6) includes a stationary insulator receptacle (8) and a movable insulator receptacle (9). The bottom side (82) of the stationary receptacle (8) has a central portion (80) which is formed with a downwardly extending projection (81). Conductors (83, 84) are mounted in the central portion (80) of the stationary receptacle (8). The conductor (83) has a bent end which extends along the bottom face of the projection (81) so as to achieve electrical contact with the positive terminal (201) of the dry cell batteries (20). The conductor (84) has a bent end which extends along the bottom side (82) of the stationary receptacle (8) and then upwardly so as to be clamped between the stationary receptacle (8) and the barrel (2) and achieve constant electrical contact with the barrel (2). The stationary receptacle (8) is further formed with a pair of arcuate through bores (85) on two sides of the central portion (80).

The movable receptacle (9) has a plate portion (91) disposed between the stationary receptacle (8) and the dry cell batteries (20) The plate portion (91) is provided with an opening (901) which receives a conductive rivet (90) that serves as a movable electrical contact. The rivet (90) is used to make or break electrical connection between the conductor (83) and the positive terminal (201) of the dry cell batteries (20). The movable receptacle (9) is further provided with a pair of arcuate extensions (92) which slidably extend into the through bores (85) of the stationary receptacle (8) and which are integrally formed with the plate portion (91). Each of the arcuate extensions (92) has an upper end which is provided with a radial outward projection (93) so as to limit the movement of the movable receptacle (9) relative to the stationary receptacle (8) and so as to prevent untimely disengagement between the same.

The lamp bulb (7) has a pair of lamp electrodes (71) which extend into the central portion (80) of the stationary receptacle (8) so as to connect electrically with the conductors (83, 84). The lamp bulb (7) extends into the open tail end of the parabolic reflector (5).

The tail cap (16) is made of a conductor material and is formed with an external screw thread (161) so as to engage threadedly with the internal screw thread (22) of the barrel (2). The tail cap (16) is provided with a conductive compression spring (17) which biases the dry cell batteries (20) in the barrel (2) toward the rivet (90). The tail cap (16) is further provided with a blind axial bore (162) to receive a spare lamp bulb.

Assembly of the first preferred embodiment is as follows:

The receptacles (8, 9) are assembled so as to form the lamp base (6). The lamp base (6) is then inserted into the barrel (2) adjacent to the first open end of the latter. Pressure is then exerted on the surface of the barrel (2) so as to dent a portion of the same. The dented portion extends into the surface of the stationary receptacle (8), thereby securing the stationary receptacle (8) in the barrel (2) and tightly clamping the conductor (84) between the barrel (2) and the stationary receptacle (8). The lamp bulb (7) is then connected to the stationary receptacle (8). The parabolic reflector (5) and the lens (4) are attached to the head (3), and the head (3) is screwed onto the barrel (2). Dry cell batteries (20) are then provided inside the barrel (2). Finally, the tail cap (14) is screwed onto the barrel (2). The preferred embodiment is now ready for use.

Figure 8:
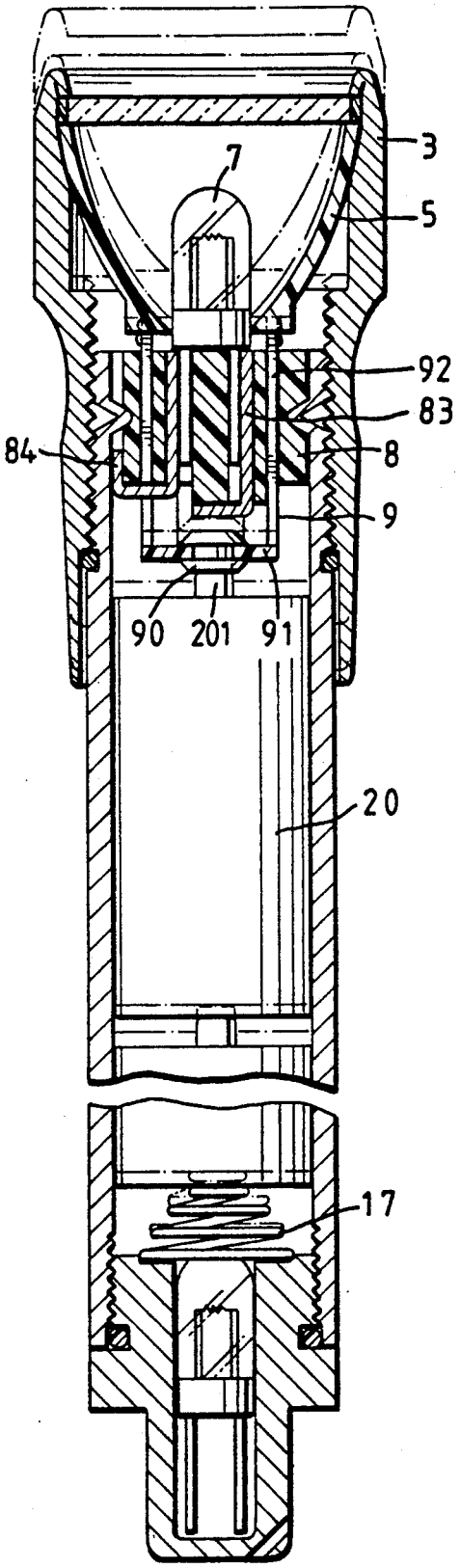
FIG. 8 is an illustration of the preferred embodiment when in use.

Referring to FIG. 8, the spring (17) urges the dry cell batteries (20) upwardly so that the positive terminal (201) of a first one of the dry cell batteries (20) touches the rivet (90) on the plate portion (91) of the movable receptacle (9). The periphery of the open tail end of the parabolic reflector (5) abuts against the upper end of the arcuate extensions (92) of the movable receptacle (9). Rotation of the head (3) relative to the barrel (2) can cause axial translation of the former. Therefore, when the head (3) is rotated in a direction toward the barrel (2), the parabolic reflector (5) pushes the movable receptacle (9) and the dry cell batteries (20) downward against the action of the spring (17), thereby separating the rivet (90) from the conductor (83). Electrical connection between the lamp bulb (7) and the dry cell batteries (20) is therefore broken, and the lamp bulb (7) does not light at this stage.

Rotation of the head (3) in a direction away from the barrel (2) causes the spring (17) to expand and push the dry cell batteries (20) and the movable receptacle (9) upward until the rivet (90) eventually touches the conductor (83), thereby electrically connecting the lamp bulb (7) and the dry cell batteries (20) to cause the lamp bulb (7) to light. Further rotation of the head (3) in this direction varies the position of the parabolic reflector (5) relative to the lamp bulb (7), thereby varying the dispersion of the light output of the preferred embodiment.

Referring once more to FIG. 4, note that the preferred embodiment is still operable even if no rivet (90) is provided in the opening (901). Under this condition, the spring (17) urges the dry cell batteries (20) so that the positive terminal (201) of a first one of the dry cell batteries (20) extends into the opening (90) and serves as the movable electrical contact for making or breaking electrical connection with the conductor (83).

The following are the advantages and characterizing features of the variable focusing flashlight of the present invention:

1. The preferred embodiment is turned off by breaking electrical contact between the rivet (90) and the conductor (83), thereby disconnecting the lamp bulb (7) from the positive terminal (201) of the dry cell batteries (20).

2. The preferred embodiment is relatively easy to assemble. The receptacles (8, 9) are engaged so as to form the lamp base (6). The lamp base (6) is then inserted into the barrel (2) and is secured to the same by denting a portion of the barrel (2).

3. The preferred embodiment has an accurate power supply switching characteristic. Rotation of the head (3) causes axial translation of the parabolic reflector (5) to move correspondingly the rivet (90) toward or away from the conductor (83).

4. Untimely disengagement of the receptacles (8, 9) seldom occurs when replacing the lamp bulb (7) or the dry cell batteries (20).

5. The manufacturing cost of the preferred embodiment is lower than that of the previously described conventional flashlight because of its less complicated construction. The preferred embodiment is not provided with a lip (111) which increases the difficulty in manufacturing the conventional flashlight.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A variable focusing flashlight comprising:

a barrel for housing a battery therein, a tail cap mounted on one end of said barrel and having a compression spring provided thereon for urging said battery towards the other end of said barrel, a lamp having a pair of terminals, a lamp base for retaining said lamp adjacent said other end of said barrel, and a head assembly rotatably mounted on said other end of said barrel and having a substantially planar lens and a substantially parabolic reflector with an open tail end to receive said lamp, said head assembly being controllably translatable along said barrel when rotated with respect to said barrel, said lamp base including:

a stationary receptacle mounted to said barrel in said other end of said barrel and having a bottom side and an axially extending through bore formed therein;

a first conductor mounted in said stationary receptacle and electrically connecting with one of said lamp terminals, said first conductor having one end which extends radially along said bottom side of said stationary receptacle within the circumference of said barrel, a second conductor mounted in said stationary receptacle and electrically coupling the other one of said lamp terminals and said barrel;

a movable receptacle having a plate portion disposed between said stationary receptacle and said battery source, said plate portion being formed with an opening and an upward extension which extends slidably into said through bore of said stationary receptacle and which is longer than said through bore; and a conductive rivet movable contact mounted to the plate portion in said opening;

said open tail end of said reflector abutting against one end of said upward extension of said movable receptacle;

rotation of said head assembly in a direction toward said barrel causing said reflector to push said movable receptacle and said battery against the action of said spring, thereby moving said movable contact away from said first conductor to break electrical connection between said lamp and said battery source; and rotation of said head assembly in a direction away from said barrel causing said spring to expand and push said movable receptacle and said movable contact toward said first conductor to make electrical connection between said lamp and said battery source.

2. A variable focusing flashlight comprising:

a barrel for housing a battery therein, a tail cap mounted on one end of said barrel and having a compression spring provided thereon for urging said battery towards the other end of said barrel, a lamp having a pair of terminals, a lamp base for retaining said lamp adjacent said other end of said barrel, and a head assembly rotatably mounted on said other end of said barrel and having a substantially planar lens and a substantially parabolic reflector with an open tail end to receive said lamp, said head assembly being controllably translatable along said barrel when rotated with respect to said barrel, said lamp base including:

a stationary receptacle mounted to said barrel in said other end of said barrel and having a bottom side and an axially extending through bore formed therein;

a first conductor mounted in said stationary receptacle and electrically connecting with one of said lamp terminals, said first conductor having one end which extends radially along said bottom side of said stationary receptacle within the circumference of said barrel, the bottom side of said stationary receptacle having a central portion which is formed with a downwardly extending projection, said one end of said first conductor extending along a bottom face of said projection, a second conductor mounted in said stationary receptacle and electrically coupling the other one of said lamp terminals and said barrel;

a movable receptacle having a plate portion disposed between said stationary receptacle and said battery source, said plate portion being formed with an opening and an upward extension which extends slidably into said through bore of said stationary receptacle and which is longer than said through bore; and a movable contact in said opening;

said open tail end of said reflector abutting against one end of said upward extension of said movable receptacle;

rotation of said head assembly in a direction toward said barrel causing said reflector to push said movable receptacle and said battery against the action of said spring, thereby moving said movable contact away from said first conductor to break electrical connection between said lamp and said battery source; and rotation of said head assembly in a direction away from said barrel causing said spring to expand and push said movable receptacle and said movable contact toward said first conductor to make electrical connection between said lamp and said battery source.

3. The variable focusing flashlight as claimed in claim 2 wherein said battery source has a positive terminal which extends toward said opening to serve as said movable contact.

4. The variable focusing flashlight as claimed in claim 2, wherein said second conductor has one end which extends along said bottom side of said stationary receptacle and then upwardly so as to be clamped between said stationary receptacle and said barrel and couple electrically said other one of said lamp electrodes and said barrel.

5. A variable focusing flashlight comprising:

a barrel for housing a battery therein, a tail cap mounted on one end of said barrel and having a compression spring provided thereon for urging said battery towards the other end of said barrel, a lamp having a pair of terminals, a lamp base for retaining said lamp adjacent said other end of said barrel, and a head assembly rotatably mounted on said other end of said barrel and having a substantially planar lens and a substantially parabolic reflector with an open tail end to receive said lamp, said head assembly being controllably translatable along said barrel when rotated with respect to said barrel, said lamp base including:

a stationary receptacle mounted to said barrel in said other end of said barrel and having a bottom side and an axially extending through bore formed therein;

a first conductor mounted in said stationary receptacle and electrically connecting with one of said lamp terminals, said first conductor having one end which extends radially along said bottom side of said stationary receptacle within the circumference of said barrel, a second conductor mounted in said stationary receptacle and electrically coupling the other one of said lamp terminals and said barrel;

a movable receptacle having a plate portion disposed between said stationary receptacle and said battery source, said plate portion being formed with an opening and an upward extension which extends slidably into said through bore of said stationary receptacle and which is longer than said through bore, said one end of said upward extension provided with a radial projection for limiting the movement of said movable receptacle relative to said stationary receptacle; and a movable contact in said opening;

said open tail end of said reflector abutting against one end of said upward extension of said movable receptacle;

rotation of said head assembly in a direction toward said barrel causing said reflector to push said movable receptacle and said battery against the action of said spring, thereby moving said movable contact away from said first conductor to break electrical connection between said lamp and said battery source; and rotation of said head assembly in a direction away from said barrel causing said spring to expand and push said movable receptacle and said movable contact toward said first conductor to make electrical connection between said lamp and said battery source.

6. The variable focusing flashlight as claimed in claim 5, wherein said battery has a positive terminal which extends toward said opening to serve as said movable contact.

* * * * *